US005209042A

United States Patent [19]

Rickard

[11] Patent Number: 5,209,042

[45] Date of Patent: May 11, 1993

[54] STRING PACKAGING APPARATUS AND METHOD

[76] Inventor: James H. Rickard, P.O. Box 98, Harwinton, Conn. 06791

[21] Appl. No.: 955,653

[22] Filed: Oct. 2, 1992

[51] Int. Cl.[5] ..... B65B 63/04

[52] U.S. Cl. ..... 53/430; 53/258; 53/284.3; 53/116

[58] Field of Search ..... 53/430, 116, 119, 118, 53/409, 204, 252, 258, 255, 260, 284.3, 573, 572, 571

[56] References Cited

U.S. PATENT DOCUMENTS

| | | | |
|---|---|---|---|
| 3,618,282 | 11/1971 | Hagel et al. | 53/430 |
| 3,975,883 | 8/1976 | Besnyo et al. | 53/430 X |
| 4,160,305 | 7/1979 | Tysver | 53/258 X |
| 4,255,917 | 3/1981 | Stone | 53/430 |

FOREIGN PATENT DOCUMENTS

| | | | |
|---|---|---|---|
| 2109776 | 6/1983 | United Kingdom | 53/430 |

*Primary Examiner*—James F. Coan

*Attorney, Agent, or Firm*—McCormick, Paulding & Huber

[57] ABSTRACT

A package comprising a resilient musical instrument string in coiled form and contained within an envelope is made by winding the string into a coil at a winding station and within a generally C-shaped opening in an insert plate. The opening is partially defined by a generally radially inwardly open groove and further defined by a mouth which opens radially outwardly through the forward end of the plate. The groove provides partial support for the coil, an unsupported portion of the coil being disposed within the region of the mouth. The plate is advanced from the winding station to a packaging station where the forward end portion of the plate and the coil carried by the plate are inserted into an envelope. A clamping mechanism at the packaging station engages opposite sides of the envelope in the region of the mouth and grips and holds the envelope and an unsupported portion of the coil disposed within the envelope. While the envelope and the coil therein are held by the clamping mechanism the insert plate is withdrawn from the envelope and separated from the resilient coil which moves through the mouth.

20 Claims, 4 Drawing Sheets

STRING PACKAGING APPARATUS AND METHOD

BACKGROUND OF THE INVENTION

This invention relates in general to packaging apparatus and methods and deals particularly with an improved machine and method for packaging a resilient flexible string or string-like member and more particularly a string for a musical instrument.

Musical instrument strings are usually individually packaged in coiled condition within conventional envelopes. The string manufacturing process, which generally requires finishing one end of a string and cutting the string to length, is usually performed by an automated machine. However, the packaging operation is more often manually performed. A typical manual string packaging operation requires manually forming the string into a coil and maintaining the string in its coiled condition while inserting it into a conventional envelope, the closing flap of which is then closed and may be sealed or manually tucked into the envelope to complete the package. Due to the resiliency of the string there is a tendency for the string to resist coiling which contributes to the tedium of the operation. This tedious, time consuming manual operation adds substantially to the cost of producing a string.

Accordingly, it is the general aim of the present invention to provide an improved method and apparatus for packaging a resilient string or string-like member in a conventional envelope having front and rear panels and a closure flap connected to one of the panels. It is a further aim of the invention to provide an apparatus which may be used in conjunction with an existing string manufacturing machine to automate the entire string producing process.

SUMMARY OF THE INVENTION

In accordance with the present invention a resilient flexible string is packaged by winding the string about an axis to form the string into a coil, providing inserting means including an insert member having a coil receiving opening partially defined by radially inwardly open groove means for supporting the coil along only a portion of its outer circumferential surface and further defined by a radially outwardly open mouth, moving the inserting means and the coil supported thereby into an envelope, applying clamping force to opposing side panels of the envelope to grip the envelope and an unsupported portion of the coil disposed between the latter side panels and in the region of the mouth, and withdrawing the inserting means from the envelope while clamping force is applied to the envelope and the coil contained within the envelope whereby the coil is separated from the inserting means by moving through the mouth of the insert members as the inserting means is withdrawn from the envelope and the coil remains in the envelope. Apparatus is provided for forming a package in the aforedescribed manner.

DETAILED DESCRIPTION OF PREFERRED EMBODIMENT

Figure 1:
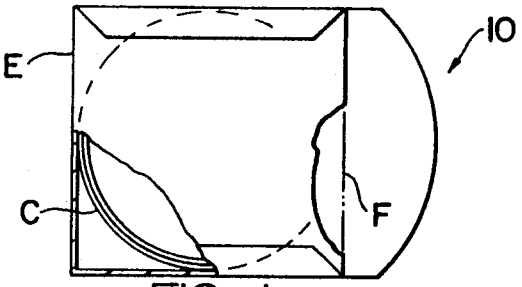
FIG. 1 is a rear view of a typical package produced by the apparatus and in accordance with the method of the present invention.

In the drawings and in the further description which follows the invention is illustrated and described with reference to a musical instrument string packaging machine for forming an instrument string into a coil and packaging the coil within a conventional envelope having front and rear panels connected together along three sides and defining an envelope mouth and a closing flap connected to one of the panels along the fourth side of the panel and forming a closure for the envelope. Such a package is shown in FIG. 1 and indicated generally by the numeral 10. The envelope is identified by the letter E and the coil by the letter C. The envelope E is shown in an open condition, the closing flap being connected to the front panel along a fold line F.

In FIGS. 2–6 a machine for forming such a package containing a musical instrument string, such as a metal guitar string, is indicated generally by the reference numeral 12, the string being designated by the letter S. The illustrated machine 12 is particularly adapted for use in conjunction with a ball-ending machine (not shown) which secures a grooved bead or ball to the end of a flexible resilient string and cuts the string to a predetermined length. The machine 12 is preferably positioned at the discharge end of a ball ending machine to receive and package each successive string S produced by the ball ending machine. However, it will be hereinafter apparent that strings may be automatically loaded into the machine 12 from any suitable magazine loading mechanism of the type having an escapement mechanism or the like for releasing a succession of individual strings.

Figure 2:
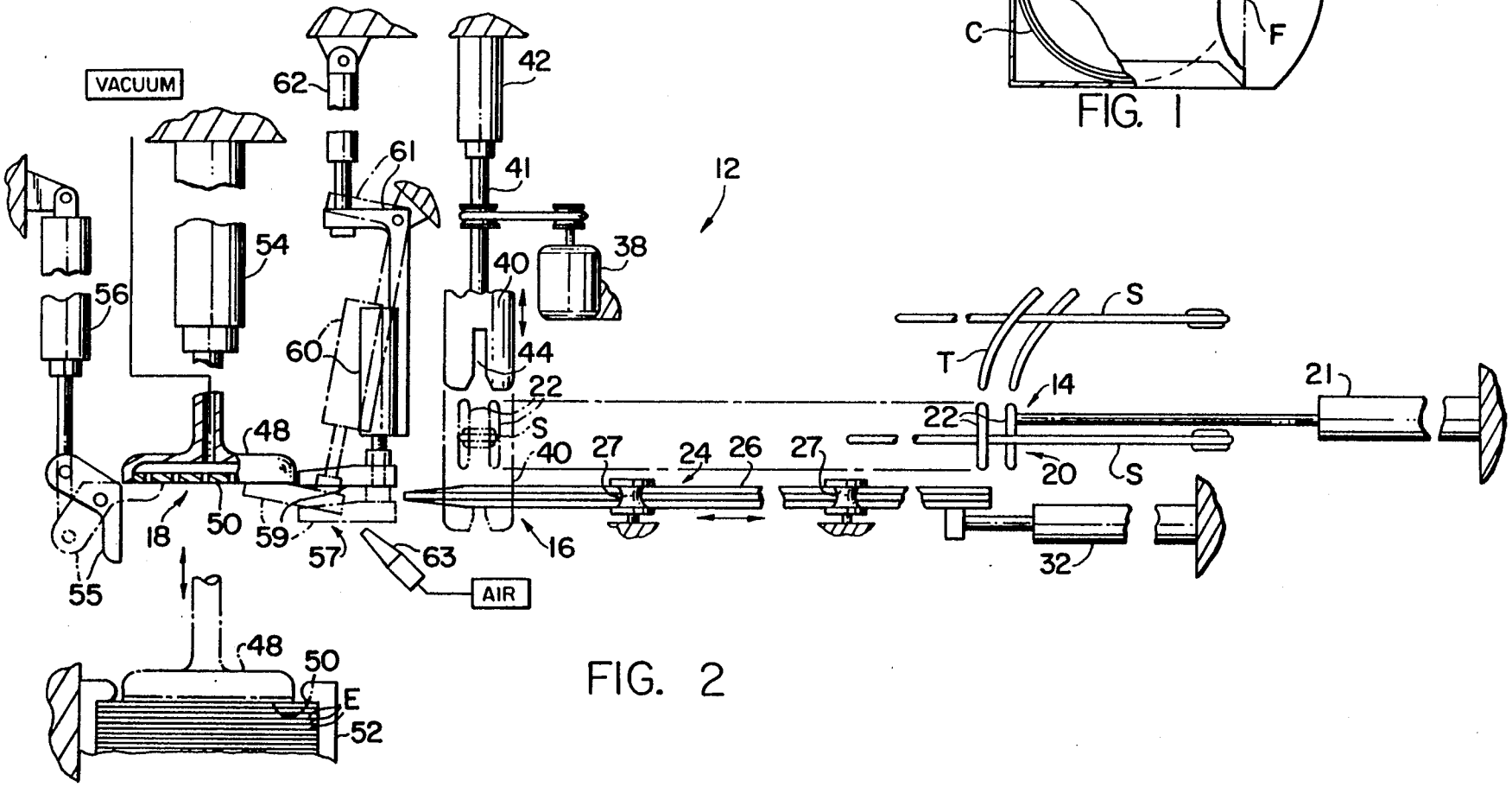
FIG. 2 is a somewhat schematic top plan view of a string packaging machine embodying the present invention.
Figure 3:
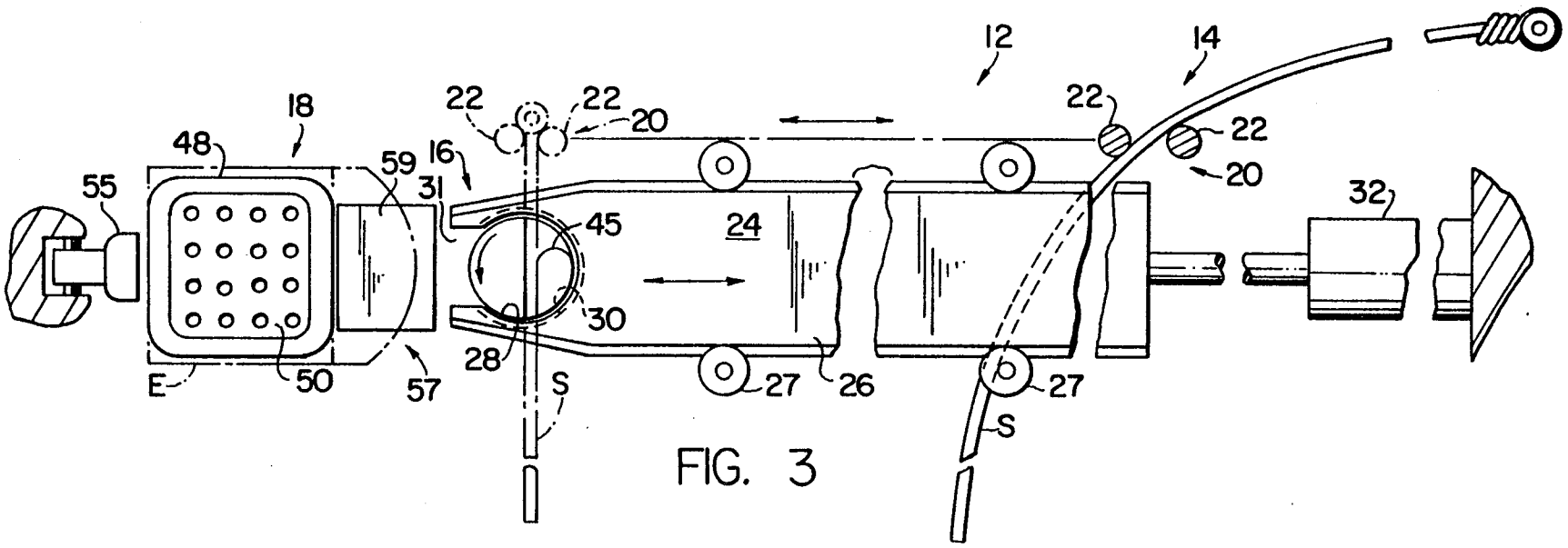
FIG. 3 is a somewhat schematic front elevational view of the string packaging apparatus.
Figure 10:
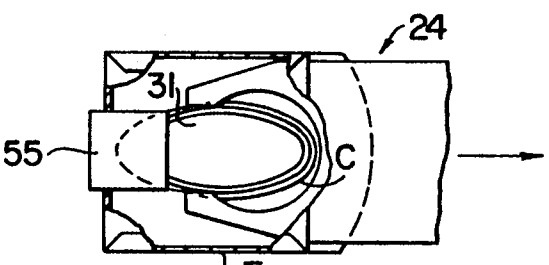
FIGS. 7–10 illustrate successive steps in the production of a package.
Figure 9:
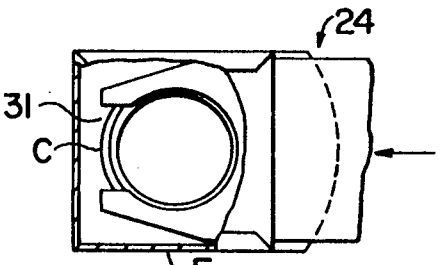
Figure 8:
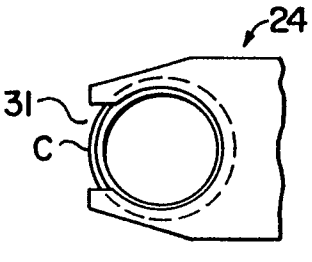
Figure 7:
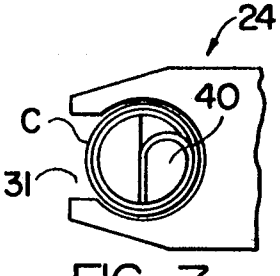
Figure 5:
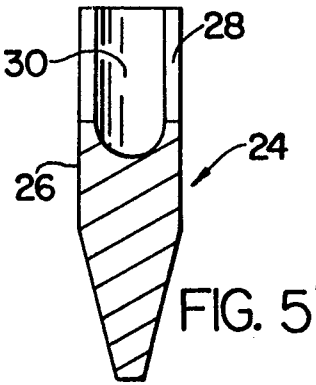
FIG. 5 is a somewhat further enlarged sectional view taken along the line 5—5 of FIG. 4.

Referring particularly to FIGS. 2 and 3 the illustrated machine 12 essentially comprises a string receiving station located at the discharge end of the ball ending machine and indicated generally at 14, a winding station indicated generally at 16, and a packaging station designated generally by the numeral 18.

A string S finished by the ball ending machine leaves the latter machine in a generally horizontally oriented position along a track T, as shown in FIG. 2, and is discharged at the string receiving station 14 into a driven trolley indicated generally by the reference numeral 20. The trolley includes a pair of generally horizontally oriented parallel bars 22, 22 which form a substantial extension of the track T when the trolley is at the string receiving station which receive therebetween a string S discharged from the ball ending machine. The trolley 20 is supported for reciprocal movement along a rectilinear path between the receiving station 14 and the winding station 16 and driven by a double acting air motor 21, shown in FIG. 2. As the trolley 20 is driven from the string receiving station 14 toward the winding station 16 the string S assumes a depending position relative to the trolley bars 22, 22 in response to the force of gravity so that the string is substantially axially vertically oriented when it reaches the winding station 16, as it appears in FIG. 3.

Figure 4:
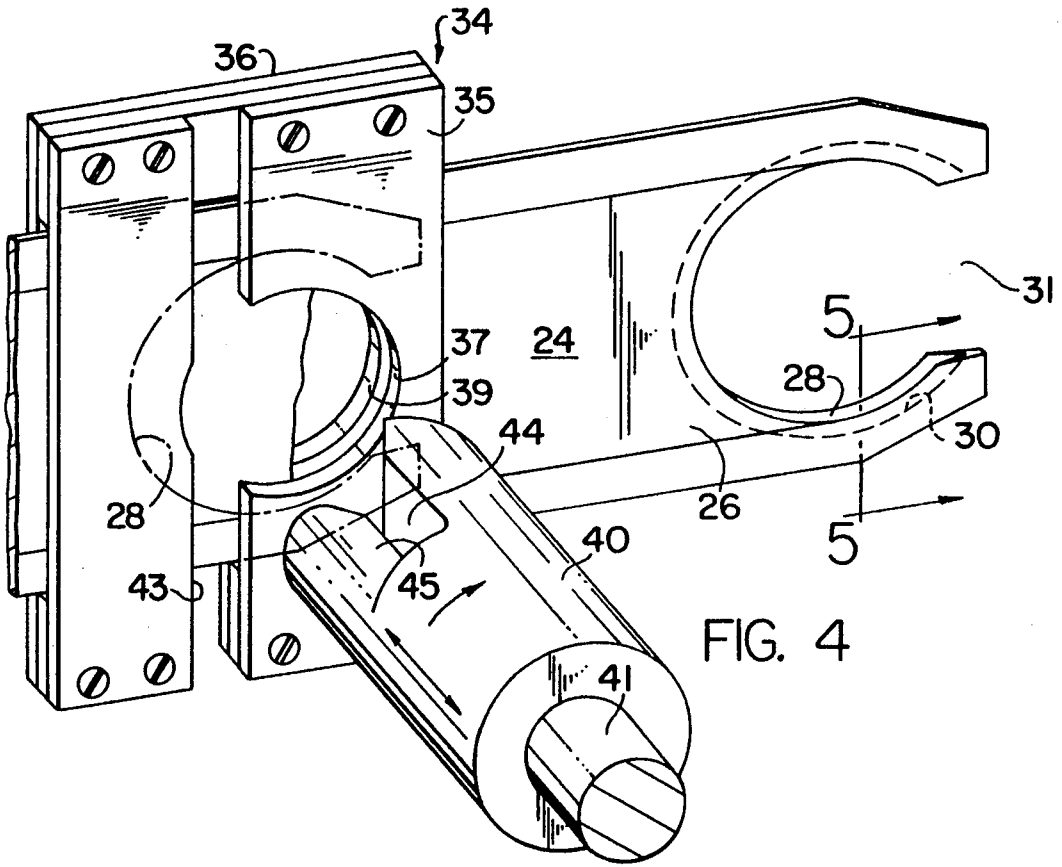
FIG. 4 is a somewhat enlarged fragmentary perspective view of the winding station.

An inserting mechanism indicated generally at 24 includes an insert member 26 which preferably comprises a relatively thin horizontally elongate and vertically disposed generally rectangular plate. The insert plate 26 is supported for horizontal reciprocal movement along a path generally parallel to the path of the trolley 20 between the winding station 16 and the packaging station 18. A plurality of support rollers 27, 27 engage upper and lower edges of the plate 26 and support it for rolling movement along its path of travel. At its forward end the insert plate 26 has a partially circular generally C-shaped opening 28 which is partially defined by a radially inwardly open trough 30, as best shown in FIG. 4. The opening 28 is further defined by a radially forwardly open mouth 31. The upper and lower edges of the plate 26 at the forward end of the plate are generally forwardly and inwardly inclined relative to each other, for a purpose which will be hereinafter evident, and as best shown in FIGS. 3 and 4.

A stripper plate assembly preferably mounted in fixed position at the winding station 16 and indicated generally by the numeral 34 includes a pair of opposing stripper plates 35 and 36 mounted at laterally opposite sides of the insert plate 26. The stripper plates have coaxially aligned cylindrical openings 37 and 39 therethrough, the latter openings being preferably somewhat smaller than the C-shaped opening 28. The C-shaped opening is generally coaxially aligned with the openings 39 and 41 when the insert plate 26 is in its winding position at the winding station 16. A laterally outwardly open vertical slot 43 extends through the stripper plate 35, as shown in FIG. 4, for a purpose to be hereinafter discussed.

Any suitable drive means may be provided for driving the insert member 26 and various other driven members hereinafter described and which comprise the machine 12. However, double acting air motors are presently employed for this purpose, the insert member being driven by an air motor 32. A Bimba Ultran rodless cylinder manufactured and marketed by Bimba Manufacturing Company, Monee, Ill., is presently preferred for providing the long stroke required to move the trolley 20 between the string receiving station 14 and the winding station 16.

Figure 6:
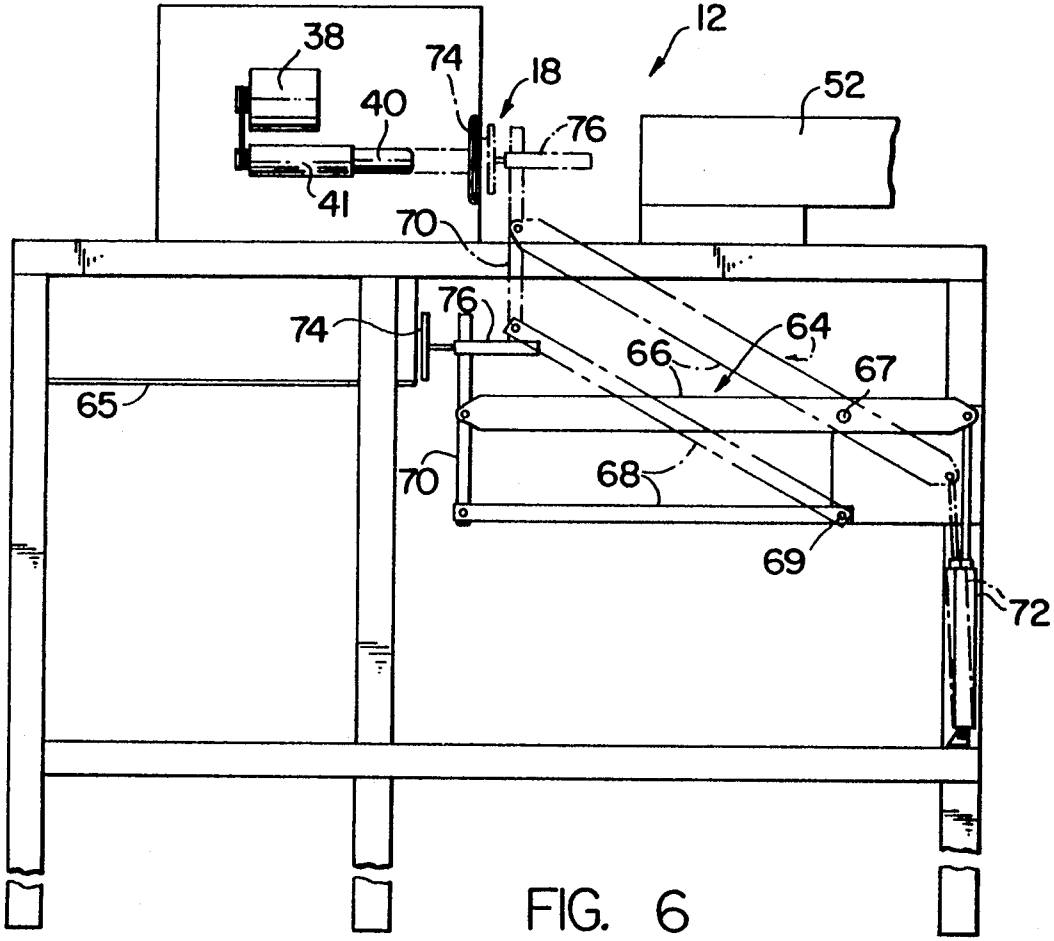
FIG. 6 is a somewhat schematic front elevational view of the machine.

A rotary spindle 41 supported at the winding station 16 for rotation about an axis coaxially aligned with the openings 37 and 39 is driven by a belt and a reversible step motor 38, best shown in FIG. 6. A generally cylindrical winding hub 40 sized to pass freely through the stripper plate openings 37 and 39 and the C-shaped opening 28 is supported by the spindle 41 for coaxial rotation with the spindle. The clearance between the hub and the C-shaped opening will be generally determined by the diameter of the string to be packaged. The hub 40 is further supported by the spindle 41 for reciprocal axial movement relative to the spindle between a retracted or full line position, wherein it is laterally spaced from the insert plate 26, and a winding position indicated by broken lines in FIG. 1, wherein it extends through the C-shaped opening 28 and the stripper plate openings 37 and 39. Reciprocal movement is imparted to the winding hub 40 by a reversible air motor indicated at 42 and anchored to the frame of the machine and shown in FIG. 2. A slot 44 formed in the winding hub 40 opens outwardly through the free end of the hub and in the direction of the insert plate 26, as best shown in FIG. 2. The walls of the slot 44 diverge laterally outward toward the free end of the hub, substantially as shown. A portion of the outer periphery of the hub in the region of the slot 44 is defined by a surface 45 which curves arcuately outwardly from one wall of the slot 44 and in a direction opposite the direction of hub winding rotation, as best shown in FIG. 3, for a purpose which will be hereinafter further evident.

A vacuum chuck 48 having a vertically disposed perforated holding surface 50 is supported at the packaging station 18 for reciprocal movement in a horizontal direction generally toward and away from an envelope dispensing magazine 52 mounted on the machine frame opposite the packaging station. The vacuum chuck 48 is supported for movement between an envelope receiving position indicated by broken lines and an envelope loading position indicated in full lines in FIG. 1. Reciprocal movement is imparted to the vacuum chuck 48 by a reversible air motor 54, shown in FIG. 2.

A clamping member 55 located at the packaging station 18 immediately forward of the vacuum chuck 48 is supported for pivotal movement about a vertical axis between a releasing position indicated by full lines and a clamping position shown in broken lines in FIG. 1. Pivotal movement is imparted to the clamping member 55 by another air motor 56 supported on the machine frame for movement relative to the frame, as shown in FIG. 2. The clamping member 55 cooperates in clamping relation with the vacuum chuck holding surface 50 when the clamping member is in its clamping or broken line position, substantially as shown.

The machine 12 also includes a flap closing mechanism indicated generally at 57 and is also located at the packaging station 18. The latter mechanism includes a flap closing member 59 carried by a reciprocally movable part of an air motor 60. The motor 60 is mounted on one leg of an L-shaped lever 61 supported on the machine frame for pivotal movement about a vertical axis relative to the frame. The other leg of the bracket 61 is attached by a slotted connection to another air motor 62, which is supported on the machine frame for pivotal movement relative to the frame.

An air nozzle 63 connected to a source of air under pressure is mounted in fixed position relative to the machine frame to direct a jet of air forwardly and inwardly toward the surface of the flap closer 59 for a purpose hereinafter discussed.

The illustrated machine 12 further includes a transfer mechanism, indicated generally at 64 in FIG. 6, for receiving a finished package 10 at the packaging station 18 and moving it to a package receiving magazine 65 mounted on the machine frame below the packaging station 18. The illustrated transfer mechanism 64 generally comprises a parallelogram linkage which includes a link 66 supported intermediate its ends for pivotal movement relative to the machine frame and about a horizontal axis indicated at 67. A link 68 is supported on the machine frame for pivotal movement about a horizontal pivot axis 69 located immediately below the pivot axis 67. A link 70 pivotally connected to ends of the links 66 and 68, substantially as shown, extends for some distance above the link 66. The extending opposite end of the link 66, that is the end remote from the packaging station, is pivotally connected to a reciprocally movable part of an air motor 72 which is, in turn, pivotally anchored to the machine frame.

The parallelogram linkage 64 carries a magnetic pickup head, indicated generally at 74, which is mounted on the movable part of an air motor 76 secured in fixed position to the upper end of the link 70. The pickup head carries one or more permanent magnets (not shown) and is supported by the air motor 76 for reciprocal movement in a horizontal direction generally toward and away from the vertical link 70.

The trolley 20, step motor 48, vacuum chuck 38, air discharge nozzle 63 and the various air motors which operate the other mechanism which comprise the machine 12 are programmed to operate in timed relation to each other, in a manner well known in the art. At the start of the machine cycle the various movable elements of the machine are in the respective full line position shown in FIG. 2. Specifically, the trolley 22 is in its string receiving position at the string receiving station 14. The inserting member 24 is in its retracted position, wherein the C-shaped opening 28 is disposed at the winding station 16, and the winding hub 40 is at rest in its retracted position, the hub slot 44 being vertically disposed and generally aligned with the stripper plate slot 43. Further, the vacuum chuck 48 is in its envelope loading position at the packaging station 18, the clamping member is in its releasing position and the closing flap member 59 is positioned with its flap engaging surface disposed generally within the plane of the vacuum chuck holding surface 50.

A string S received from the track T by the trolley 20 is carried to the winding station by the driven trolley. During its travel to the winding station the string S moves to an axially vertically oriented position, as previously discussed, and upon reaching the winding station 16 is vertically suspended from the trolley 20 between the inserting member 24 and the hub 40 and in alignment with the slots 43 and 44.

The hub 40 then moves from its retracted position toward and into the C-shaped opening 28 capturing the string S within the slot 44 and moving the string off of the trolley 20 which then returns to its string receiving position at the string receiving station 14 in preparation for receiving the next string S discharged from the ball ending machine.

When the winding hub 40 attains its winding position, indicated by broken lines in FIG. 2, the step motor 38 is energized causing the winding hub 40 to rotate in counterclockwise or winding direction as viewed in FIG. 3, drawing the string S upwardly through the slot 43 and into the C-shaped opening. The hub cooperates with the edges of the insert member 26 and the stripper plate assembly 34 and more specifically with the edges of the slot 43 and the opening 28 to impose a drag on the string as it is drawn into the opening 28 to aid in winding the string about the hub 40. The gradually outwardly curved hub surface portion 45 prevents the string S from kinking as it is coiled about the winding hub to form a coil C. When the coil C is fully formed, rotation of the winding hub 40 is arrested by the step motor 38. When a highly flexible string of small diameter is wound there is a tendency for the spring to wind onto the hub. However, due to the resilience of the string the resulting coil C has a natural tendency to expand and will expand radially outward into the trough 30. The step motor 38 may be programmed to reverse direction upon completion of the winding cycle to rotate the winding hub 40 through an angle of a few degrees about its axis whereby to assure release of the resilient string S from the hub 40 and allow it to radially expand into the C-shaped trough 30 which engages only a portion of the outer circumferential surface of the formed coil C. When a stiffer string is wound, that is a string which has a greater resistance to bending, the string may wind directly into the groove in response to rotation of the hub 40 in its winding direction. When the coil C is fully contained within the trough 30 the air motor 42 reverses direction moving the winding hub 40 from its winding position to its retracted position, wherein it is wholly removed from the insert plate 26 and the stripper plate 34.

While the latter operations are being performed to form and position the coil C, the air motor 54 operates to move the vacuum chuck 48 from its envelope loading position to its envelope receiving position to pickup an open envelope 10 from the envelope magazine 52. The vacuum chuck 48 immediately returns to its full line or envelope loading or holding position of FIG. 1 carrying with it an envelope E. The vacuum chuck holding surface 50 is preferably sized to generally complement the back panel surface of an envelope E so that the envelope fold line F is generally aligned with the rear edge of the vacuum chuck 48. The extending closing flap of the envelope overlies the face or envelope engaging surface of the flap closing member 59. When the envelope is properly positioned at the packaging station 18, air under pressure is fed to the air nozzle 63 which directs a jet of air toward the envelope closing flap and the mouth of the envelope E to somewhat inflate the envelope causing the envelope front and rear panels to separate thereby opening the mouth of the envelope.

The insert plate 26 is advanced by the air motor 32 from the winding station 14 to the packaging station 16 causing the forward end portion of the plate to enter the envelope E carrying with it the coil C. While the forward end of the insert plate 26 and the coil C are disposed within the envelope E the air motor 56 operates to move the clamping member 55 from its releasing position to its clamping position to clamp the envelope against the vacuum chuck holding surface 50. The clamping member 55 cooperates with the vacuum chuck surface 50 to grip associated portions of the envelope front and rear panels and an unsupported portion of the coil C disposed between the latter panels and within the region of the mouth 31, that is the portion of the coil C which is not disposed within and supported by the trough 30. While clamping member 55 remains in clamped position the insert plate 26 is withdrawn from the envelope to return to its winding position at the winding station leaving behind the resilient coil which is pulled through the mouth 31 by return movement of the insert plate 26 relative to the clamping member 55. In FIGS. 7–10 successive steps of winding a coil C, expanding the coil within the opening 28, inserting the coil C into an envelope E and withdrawing the inserting plate from the envelope are illustrated somewhat schematically.

At the commencement of the flap closing cycle the envelope closing flap overlies the flap engaging surface of the flap closing member 50 which is then disposed within the plane of the holding surface 50. The clamping member 55 preferably remains in its clamping position during the flap closing cycle. The air motor 60 next operates to move the flap closing member 59 in a direction generally normal to the plane of the surface 50 which causes the closing flap to move through an angle of 90 degrees about the fold line F, as viewed from above in FIG. 2. Thereafter, the air motor 62 operates to pivot the arm 61 in clockwise direction from its full line to its broken line position of FIG. 1 causing the envelope flap to be folded inwardly against the envelope back panel.

Upon completion of the flap closure operation the air motors 60 and 62 returns the flap closing member 59 to its inactive position and the motor 56 returns the clamping member 55 to its releasing position leaving the formed package adhered to the surface of the vacuum chuck 48 by vacuum applied to the chuck.

Upon completion of the package forming operation the air motor 72 shown in FIG. 6 operates the parallelogram linkage 64 to raise the magnetic chuck 74 from its lowered or full line position of FIG. 6, wherein it is aligned with the envelope receiving magazine 65, to its raised position wherein the magnetic chuck 74 is disposed in general opposing relation to the vacuum chuck 48. The air motor 76 then operates to move the magnetic pickup head 74 toward the vacuum chuck 48 and into engagement with or closely opposing relation relative to the package 10 held by the vacuum chuck. When the vacuum is released from the vacuum chuck the magnetic force exerted upon the metallic coil C within the envelope E causes the package 10 to separate from the vacuum chuck 48 and adhere to the magnetic pickup head 74. Thereafter the air motor 76 reverses and the motor 72 operates to lower the parallelogram linkage to its full line position of FIG. 6 wherein the magnetic pickup head 74 is aligned with the package receiving magazine 65. The air motor 76 again operates to push the finished package 10 envelope into the package receiving magazine 65 which grips the package 10 with sufficient holding force to separate the package from the magnetic pickup head when the air motor 76 is reversed.

In order to permit a substantially continuous operation of the machine 12 in timed relation with the ball ending machine a second package receiving magazine (not shown) may be located immediately below the first magazine 65 and a sensing device (not shown) may be provided for detecting the presence of a full charge of packages within the first magazine 65. The sensing device may be used to generate a signal to alter the stroke length of the air motor 72 so that the parallelogram linkage 64 will move to the lower position in alignment with the second magazine each time a finished envelope package is transferred from the loading station 18.

The front wall of each package receiving magazine may be hinged along its lower edge for movement from a vertical or magazine closing position to a substantially horizontal open position to support a carton for receiving a charge of envelopes from the magazine when the magazine contains a full charge of envelopes. An appropriate pusher mechanism may also be provided for moving the envelopes from the magazine into the carton.

I claim:

1. Apparatus for forming a package including an envelope containing a resilient flexible string in the form of a coil, said apparatus comprising insert means for positioning within an envelope a coil to be packaged and including an insert number having an opening therein partially defined by radially inwardly open groove means for receiving and supporting a portion of the outer circumferential surface of the coil to be packaged and further defined by a radially outwardly open mouth, the coil having an unsupported portion in the region of said mouth, means for moving into the envelope said insert means and the coil supported by said insert means, clamping means for engaging opposing outer surface portions of the envelope in the region of said unsupported portion of the coil within the envelope to simultaneously grip and hold the envelope and the unsupported portion therein, and means for moving said insert member and said clamping means in generally radially opposite directions relative to each other to withdraw said insert means from the envelope and separate the coil from said insert means by movement of the coil through said mouth whereby the coil remains within the envelope.

2. Apparatus as set forth in claim 1 wherein said opening comprises a generally C-shaped opening.

3. Apparatus as set forth in claim 2 wherein said groove means comprises a partially circular groove having end portions terminating at said mouth.

4. Apparatus for forming a package as set forth in claim 1 including winding means for receiving a string to be packaged and forming the string into a coil within said opening.

5. Apparatus for forming a package as set forth in claim 4 wherein the coil formed by said winding means resiliently diametrically expands into said groove means.

6. Apparatus for forming a package as set forth in claim 4 wherein aid winding means cooperates with the insert means to form the string into a coil.

7. Apparatus for forming a package as set forth in claim 5 wherein the string is drawn into said opening by said winding means and said insert means cooperates with said winding means to apply drag to the string as the string is drawing in said opening.

8. Apparatus for forming a package as set forth in claim 7, wherein said insert means includes a stripper plate disposed generally adjacent an associated side of said opening for receiving said winding means therethrough and retaining within said opening the coil formed by said winding means.

9. Apparatus for forming a package as set forth in claim 4 wherein said winding means comprises a winding hub and means for supporting said winding hub for axial movement into and out of said opening and for rotation within said opening, means for moving said winding hub into and out of said opening, and means for rotating said winding hub within said opening.

10. Apparatus for forming a package as set forth in claim 9 including means for supporting the string to be packaged between said winding hub and said opening and wherein said winding hub has a slot therein for capturing an associated portion of the string as the winding hub moves into said opening.

11. Apparatus for forming a package including a generally rectangular envelope having a front panel and a back panel connected together along three side edges and defining an envelope mouth and a closure flap connected along a fold line to the fourth side edge of the back panel, and a resilient flexible string in the form of a coil contained within the envelope, said apparatus comprising a winding station and a package forming station, insert means for positioning within an envelope a coil to be packaged and including a horizontally elongate and vertically disposed insert plate having a generally C-shaped opening at its forward end partially defined by radially inwardly open groove means for receiving a coil to be packaged and further defined by a radially forwardly open mouth, means for supporting said insert plate for reciprocal forward and rearward movement between a winding position wherein said opening is disposed at said winding station and an inserting position wherein said opening is disposed at said packaging station, means for supporting a string at said winding station, winding means at said winding station including a winding hub supported for axially movement into and out of said opening and for rotation within said opening when said insert means is in its winding position and having a slot therein for capturing the string as winding hub moves into said opening, means for moving said winding hub into and out of said opening, means for rotating said winding hub in a winding direction within said opening, said winding hub cooperating with said insert plate in its winding position to form the string into a coil within said opening, said groove means receiving the coil formed by said winding means and supporting a portion of the outer circumferential surface of the coil, the coil having an unsupported portion in the region of said mouth, means for supporting an envelope at said packaging station to receive the forward end portion of said insert means when said insert plate is in its inserting position, clamping means at said packaging station for engaging opposing outer surface portions of the front and rear panels of the envelope and gripping and holding the envelope and an unsupported portion of the coil disposed between the front and rear panels and supported within said C-shaped opening, and means for moving the insert plate from its packaging position toward its winding position while the envelope and the coil contained therein are gripped and held by said clamping means to withdraw the insert plate from the envelope and separate the coil within the envelope from the insert plate by movement of the coil through said mouth, whereby the coil remains disposed within the envelope.

12. Apparatus as set forth in claim 11 including an envelope dispensing magazine disposed in generally opposing relation to said packaging station and said envelope holding means comprises means for receiving an envelope from aid envelope dispensing magazine and for moving the envelope to and supporting the envelope at said packaging station.

13. Apparatus as set forth in claim 12 including flap closing means supported at said packaging station for moving the envelope closing flap to closed position after the insert means has been withdrawn from the envelope.

14. Apparatus as set forth in claim 11 including a string receiving station and trolley means for receiving a string at said receiving station and moving it to and supporting it at the winding station.

15. Apparatus as set forth in claim 14 wherein the string is received by the trolley means in a generally horizontally oriented position and moves to a generally vertically depending position relative to said trolley means during the movement of said trolley means from said string receiving station to said winding station.

16. Apparatus as set forth in claim 11 including means for rotating said winding hub in a direction opposite said winding direction.

17. A method for packaging a resilient flexible string comprising the steps of winding a string to be packaged about an axis to form the string into a coil, providing inserting means having an opening partially defined by radially inwardly open groove means for supporting the coil along only a portion of its outer circumferential surface and a radially outwardly open mouth, inserting the inserting means and the coil supported thereby into an envelope, applying clamping force to opposite sides of the envelope to grip and hold the envelope and an unsupported portion of the coil disposed within the envelope between the opposite sides, and withdrawing the inserting means from the envelope while the clamping force is applied to the envelope and unsupported portion of the coil contained within the envelope to separate said inserting means from the coil by movement of the coil through said mouth.

18. A method for packaging a resilient flexible string as set forth in claim 17 including the additional step of expanding the coil radially outwardly into supporting engagement with said groove means.

19. A method for packaging a resilient flexible string as set forth in claim 18 wherein the step of expanding the coil is further characterized as allowing the coil to resiliently expand within said opening.

20. A method for packaging a resilient flexible string as set forth in claim 17 wherein the step of winding is performed within the said opening.

* * * * *